US009719253B2

(12) United States Patent
Stahl, Jr. et al.

(10) Patent No.: US 9,719,253 B2
(45) Date of Patent: Aug. 1, 2017

(54) HEAD-OF-WALL TOP TRACK GASKET MEMBER FOR ACOUSTIC AND FIRESTOPPING INSULATION

(71) Applicant: Specified Technologies Inc., Somerville, NJ (US)

(72) Inventors: James P. Stahl, Jr., Princeton, NJ (US); Paul Gandolfo, Doylestown, PA (US)

(73) Assignee: Specified Technologies Inc., Somerville, NJ (US)

( * ) Notice: Subject to any disclaimer, the term of this patent is extended or adjusted under 35 U.S.C. 154(b) by 73 days.

(21) Appl. No.: 14/747,259

(22) Filed: Jun. 23, 2015

(65) Prior Publication Data

US 2015/0368898 A1 Dec. 24, 2015

Related U.S. Application Data

(60) Provisional application No. 61/998,187, filed on Jun. 23, 2014.

(51) Int. Cl.

| | |
|---|---|
| ***E04B 2/82*** | (2006.01) |
| ***E04B 1/24*** | (2006.01) |
| ***E04B 1/94*** | (2006.01) |
| ***E04B 2/58*** | (2006.01) |
| ***E04B 2/74*** | (2006.01) |

(52) U.S. Cl.

CPC ..... *E04B 2/825* (2013.01); *E04B 1/24* (2013.01); *E04B 1/94* (2013.01); *E04B 1/944* (2013.01); *E04B 1/947* (2013.01); *E04B 1/948* (2013.01); *E04B 2/58* (2013.01); *E04B 2/7409* (2013.01)

(58) Field of Classification Search

CPC ... E04B 1/24; E04B 1/94; E04B 1/944; E04B 1/947; E04B 1/948; E04B 2/58; E04B 2/7411; E04B 2/76; E04B 2/82; E04C 2003/0404; E04C 3/04; E04C 3/32

USPC ..... 52/232, 41, 481.2, 481.1, 633, 690, 52/745.092

See application file for complete search history.

(56) References Cited

U.S. PATENT DOCUMENTS 3,453,790 A * 7/1969 Harris ..... E04B 2/821 52/126.3
4,103,463 A * 8/1978 Dixon ..... E04B 2/824 52/126.4
4,130,972 A * 12/1978 Varlonga ..... E04B 2/825 52/241

(Continued)

*Primary Examiner* — Joshua J Michener
*Assistant Examiner* — Matthew Gitlin
(74) *Attorney, Agent, or Firm* — Fox Rothschild LLP

(57) ABSTRACT

A sealing gasket assembly for sealing a head-of-wall construction including a member body having a top member with first and second spaced apart side panels depending from the top member. The intersection of the first side panel and the top member defines a first inside corner and a first outside corner and the intersection of the second side panel and the top member defines a second inside corner and a second outside corner. A supplemental sealing member extends along each of the first and second outside corners. Each supplemental sealing member is manufactured from a flexible material and is configured such that a panel abutment portion thereof extends along at least a portion of an outside surface of the respective side panel and a return portion extends along at least a portion of an outside surface of the top member.

28 Claims, 5 Drawing Sheets

(56) References Cited

U.S. PATENT DOCUMENTS 4,430,832 A * 2/1984 Kaiser ..... E04B 2/82 52/238.1
5,010,702 A * 4/1991 Daw ..... E04B 2/82 52/241
5,127,203 A * 7/1992 Paquette ..... E04B 2/822 52/241
5,140,792 A * 8/1992 Daw ..... E04B 2/7409 52/238.1
5,787,651 A * 8/1998 Horn ..... E04B 2/7412 52/144
7,152,385 B2 * 12/2006 Morgan ..... E04B 2/7411 383/120
7,617,643 B2 * 11/2009 Pilz ..... E04B 1/948 52/232
7,681,365 B2 * 3/2010 Klein ..... E04B 2/7411 52/1
7,950,198 B2 * 5/2011 Pilz ..... E04B 1/948 454/258
8,087,205 B2 * 1/2012 Pilz ..... E04B 1/948 52/232
8,181,404 B2 * 5/2012 Klein ..... E04B 2/7411 52/232
8,413,394 B2 * 4/2013 Pilz ..... E04B 2/7411 52/207
8,555,566 B2 * 10/2013 Pilz ..... E04B 2/828 52/167.1
8,595,999 B1 * 12/2013 Pilz ..... E04B 1/943 52/232
8,640,415 B2 * 2/2014 Pilz ..... E04B 2/7411 52/232
8,938,922 B2 * 1/2015 Pilz ..... E04B 1/948 52/232
9,458,628 B2 * 10/2016 Pilz ..... E04B 2/7411
2004/0010998 A1 * 1/2004 Turco ..... E04F 13/0826 52/762
2009/0049781 A1 * 2/2009 Pilz ..... E04B 1/948 52/481.1
2011/0113709 A1 * 5/2011 Pilz ..... E04B 1/948 52/232
2011/0167742 A1 * 7/2011 Klein ..... E04B 2/7457 52/232
2013/0086859 A1 * 4/2013 Pilz ..... E04B 1/948 52/232
2013/0091790 A1 * 4/2013 Stahl, Jr. ..... E04B 1/948 52/232
2013/0186020 A1 * 7/2013 Pilz ..... E04B 2/7411 52/232
2015/0135622 A1 * 5/2015 Muenzenberger ..... E04B 1/948 52/407.1
2015/0135631 A1 * 5/2015 Foerg ..... E04B 2/7411 52/717.04

* cited by examiner

HEAD-OF-WALL TOP TRACK GASKET MEMBER FOR ACOUSTIC AND FIRESTOPPING INSULATION

This application claims the benefit of U.S. Provisional Application No. 61/998,187, filed on Jun. 23, 2014, the contents of which are incorporated herein by reference.

BACKGROUND OF THE INVENTION

1. Field of the Invention

The present invention deals with the field of head-of-wall top track gasket members for providing acoustic and firestopping insulation between the upper edge of floors and the ceilings located immediately thereabove. Many attempts have been made to seal between a room ceiling and a wall construction therebelow, however it is rather difficult because of irregular surfaces against which the seal needs to be made and because in some situations effective acoustic sealing may require somewhat different materials and constructions than the firestopping sealing designs. The present invention integrates insulating material for achieving both acoustic and firestopping sealing simultaneously in a head-of-wall area between the top track above a wall construction and the undersurface of the floor thereabove.

2. Description of the Prior Art

Various constructions have been shown for the purposes of head-of-wall firestopping insulations such as shown in U.S. Pat. No. 5,010,702 issued Apr. 30, 1991 to T. L. Daw et al and assigned to Daw Technologies, Inc. on a "Modular Wall System"; and U.S. Pat. No. 5,127,203 issued Jul. 7, 1992 to R. F. Paquette on a "Seismic/Fire Retardant Wall Structure And Method"; and U.S. Pat. No. 5,755,066 issued May 26, 1998 to D. W. Becker on a "Slip Track Assembly"; and U.S. Pat. No. 5,913,788 issued Jun. 22, 1999 to T. R. Herren on a "Fire Blocking And Seismic Resistant Wall Structure"; and U.S. Pat. No. 5,921,041 issued Jul. 13, 1999 to J. D. Egri, II on a "Bottom Track For Wall Assembly"; and U.S. Pat. No. 5,950,385 issued Sep. 14, 1999 to T. R. Herren on an "Interior Shaft Wall Construction"; and U.S. Pat. No. 6,058,668 issued May 9, 2000 to T. R. Herren on a "Seismic And Fire-Resistant Head-Of-Wall Structure"; and U.S. Pat. No. 6,176,053 issued Jan. 23, 2001 to R. C. A. St. Germain and assigned to Roger C. A. St. Germain on a "Wall Track Assembly And Method For Installing The Same"; and U.S. Pat. No. 7,043,880 issued May 16, 2006 to M. D. Morgan et al and assigned to W. R. Grace & Co.-Conn. on "In Situ Molded Thermal Barriers"; and U.S. Pat. No. 7,152,385 issued Dec. 26, 2006 to M. D. Morgan et al and assigned to W. R. Grace & Co.-Conn. on "In Situ Molded Thermal Barriers"; and U.S. Pat. No. 7,240,905 issued Jul. 10, 2007 to J. P. Stahl, Sr. and assigned to Specified Technologies Inc. on a "Method And Apparatus For Sealing A Joint Gap Between Two Independently Movable Suuctural Substrates"; and U.S. Pat. No. 7,617,643 issued Nov. 17, 2009 to D. A. Pilz et al and assigned to California Expanded Metal Products Company on a "Fire-Ratted Wall Construction Product"; and U.S. Pat. No. 7,681,365 issued Mar. 23, 2010 to J. A. Klein on a "Head-Of-Wall Fireblock Systems And Related Wall Assemblies"; and U.S. Pat. No. 7,752,817 issued Jul. 13, 2010 to D. A Pilz et al and assigned to California Expanded Metal Products Company on a "Two-Piece Track System"; and U.S. Pat. No. 7,814,718 issued Oct. 19, 2010 to J. A. Klein on "Head-Of-Wall Fireblocks"; and U.S. Pat. No. 7,866,108 issued Jan. 11, 2011 to J. A. Klein on "Head-Of-Wall Fireblock Systems And Related Wall Assemblies"; and U.S. Pat. No. 7,950,198 issued May 31, 2011 to D. A. Pilz et al and assigned to California Expanded Metal Products Company on a "Fire-Rated Wall Construction Product"; and U.S. Pat. No. 8,056,293 issued Nov. 15, 2011 to J. A. Klein on "Head-Of-Wall Fireblock Systems And Related Wall Assemblies"; and U.S. Pat. No. 8,087,205 issued Jan. 2, 2012 to D. A. Pilz et al and assigned to California Expanded Metal Products Company on a "Fire-Rated Wall Construction Product"; and U.S. Pat. No. 8,132,376 issued Mar. 13, 2012 to D. A. Pilz et al and assigned to California Expanded Metal Products Company on a "Two-Piece Track System"; and U.S. Pat. No. 8,1811,404 issued May 22, 2012 to J. A. Klein on "Head-Of-Wall Fireblocks And Related Wall Assemblies"; and U.S. Pat. No. 8,281,552 issued Oct. 9, 2012 to D. A. Pilz et al and assigned to California Expanded Metal Products Company on an "Exterior Wall Construction Product"; and U.S. Pat. No. 8,298,967 issued Oct. 30, 2012 to W. F. Egan et al and assigned to BASF Corporation on an "Exterior Finishing System And Building Wall Containing A Corrosion-Resistant Enhanced Thickness Fabric"; and U.S. Pat. No. 8,316,605 issued Nov. 27, 2012 to C. Oberg on an "Insulated Metal Roofing And Wall Systems And Related Methods"; and U.S. Pat. No. 8,499,512 issued Aug. 6, 2013 to D. A. Pilz et al and assigned to California Expanded Metal Products Company on an "Exterior Wall Construction Product"; and U.S. Pat. No. 8,555,566 issued Oct. 15, 2013 to D. A. Pilz et al and assigned to California Expanded Metal Products Company on a "Two-Piece Track System"; and U.S. Pat. No. 8,590,231 issued Nov. 26, 2013 to D. A. Pilz and assigned to California Expanded Metal Products Company on "Fire-Rated Joint System"; and U.S. Pat. No. 8,595,999 issued Dec. 3, 2013 to D. A. Pilze et al and assigned to California Expanded Metal Products Company on a "Fire-Rated Joint System"; and U.S. Pat. No. 8,640,415 issued Feb. 4, 2014 to D. A. Pilze et al and assigned to California Expanded Metal Products Company on a "Fire-Rated Wall Construction Products"; and U.S. Pat. No. 8,671,632 issued Mar. 18, 2014 to D. A. Pilz et al and assigned to California Expanded Metal Products Company on a "Wall Gap Fire Block Device, System And Method"; and U.S. Publication No. 2009/0178363 published Jul. 16, 2009 to D. A. Pilz and assigned to California Expanded Metal Products Compay on an "Exterior Wall Construction Product"; and U.S. Publication No. 2009/0223159 published Sep. 10, 2009 to M. Colon on a "Firestop Block And Thermal Barrier System For Fluted Metal Decks"; and U.S. Publication No. 2011/0011019 published Jan. 20, 2011 to J. P. Stahl, Jr. et al and assigned to Specified Technologies Inc. on a "Firestopping Sealing Means For Use With Gypsum Wallboard In Head-Of-Wall Construction"; and U.S. Publication No. 2011/0113709 published May 19, 2011 to D. A. Pilz et al and assigned to California Expanded Metal Products Company on a "Wall Gap Fire Block Device, System And Method"; and U.S. Publication No. 2011/0185656 published Aug. 4, 2011 to J. A. Klein on a "Fire Retardant Cover For Fluted Roof Deck"; and U.S. Publication No. 2011/0214371 published Sep. 8, 2011 to J. A. Klein on an "Offset Leg Framing Element For Fire Stop Applications"; and U.S. Publication No. 2011/0247281 published Oct. 13, 2011 to D. A. Pilz et al and assigned to California Expanded Metal Products Company on a "Fire-Rated Wall Construction Product"; and U.S. Publication No. 2013/0008104 published Jan. 10, 2013 to M. Caboni on a "Building Construction For Making Transpirable Walls And Floors"; and U.S. Publication No. 2013/0034683 published Feb. 7, 2013 to H. Kramer et al on a "Foam Insulation Unit"; and U.S. Publication No. 2013/

0074432 published Mar. 28, 2013 to R. I. Ciuperca on an "Insulated Concrete Form And Method Of Using Same".

SUMMARY OF THE INVENTION

In at least one embodiment, the present invention provides a sealing gasket assembly for sealing a head-of-wall construction, the wall construction including a ceiling track secured relative to a floor underside and supporting a plurality of studs. The gasket assembly includes a member body including a top member with first and second spaced apart side panels depending from the top member and defining an opening configured to receive the ceiling track within the member body. The intersection of the first side panel and the top member defines a first inside corner and a first outside corner and the intersection of the second side panel and the top member defines a second inside corner and a second outside corner. A supplemental sealing member extends along each of the first and second outside corners. Each supplemental sealing member is manufactured from a flexible material and is configured such that a panel abutment portion thereof extends along at least a portion of an outside surface of the respective side panel and a return portion extends along at least a portion of an outside surface of the top member.

In at least one embodiment, a lip extends outwardly from each supplemental sealing member return portion at an acute angle relative to the top member.

In at least one embodiment, the gasket assembly further includes a firestopping member, manufactured from a firestopping material, positioned in each of the first and second inside corners.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
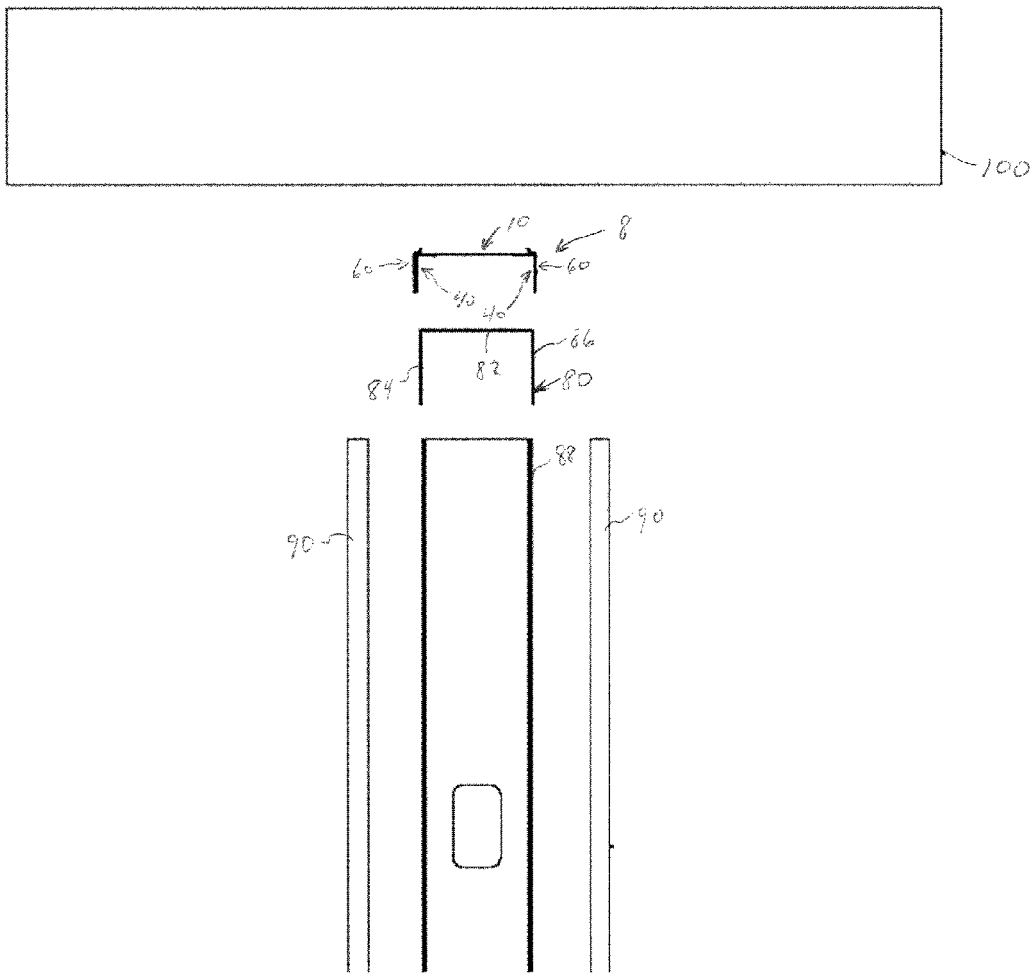
FIG. 1 is an exploded, side cross-sectional view of an exemplary head-of-wall firestopping construction in accordance with an embodiment of the present invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to FIG. 1, a gasket assembly 8 in accordance with an embodiment of the invention is positioned between a head-of-wall top track 80 and the bottom of the floor 100 above for acoustic and firestopping insulation. In the illustrated conventional construction, the track member 80 is secured to the floor 100 and has a top track section 82 with a first side track section 84 extending downwardly from one side thereof and a second track section 86 extending downwardly from the opposite side thereof. Normally the first and second side track sections are spaced apart from one another to define a recess therebetween for receiving a wall configuration such as studs 88. Wallboard 90 or the like is then secured to the track member 80 and studs 88 to define the wall construction.

Figure 2:
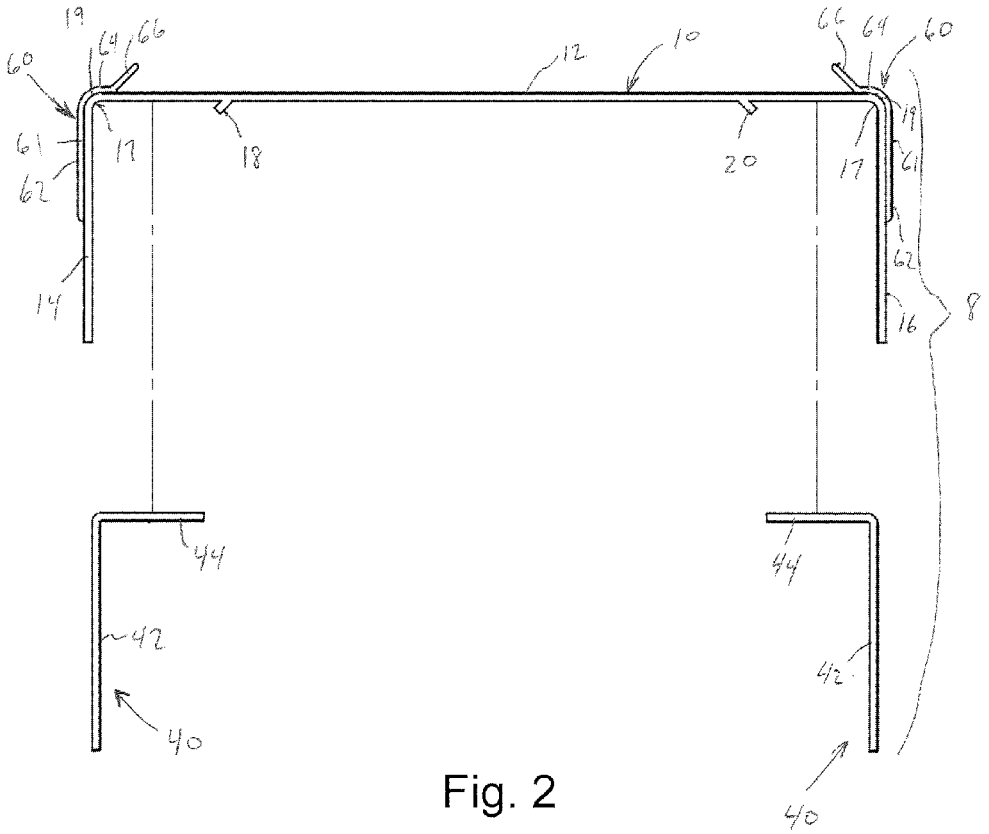
FIG. 2 is a partially exploded end elevation view of an exemplary gasket assembly in accordance with an embodiment of the invention.
Figure 3:
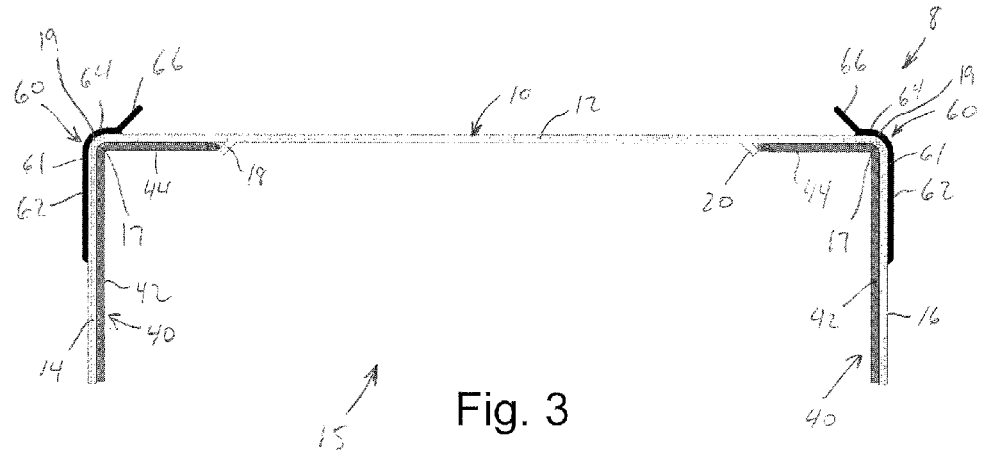
FIG. 3 is an assembled end elevation view of an exemplary gasket assembly in accordance with an embodiment of the invention.
Figure 4:
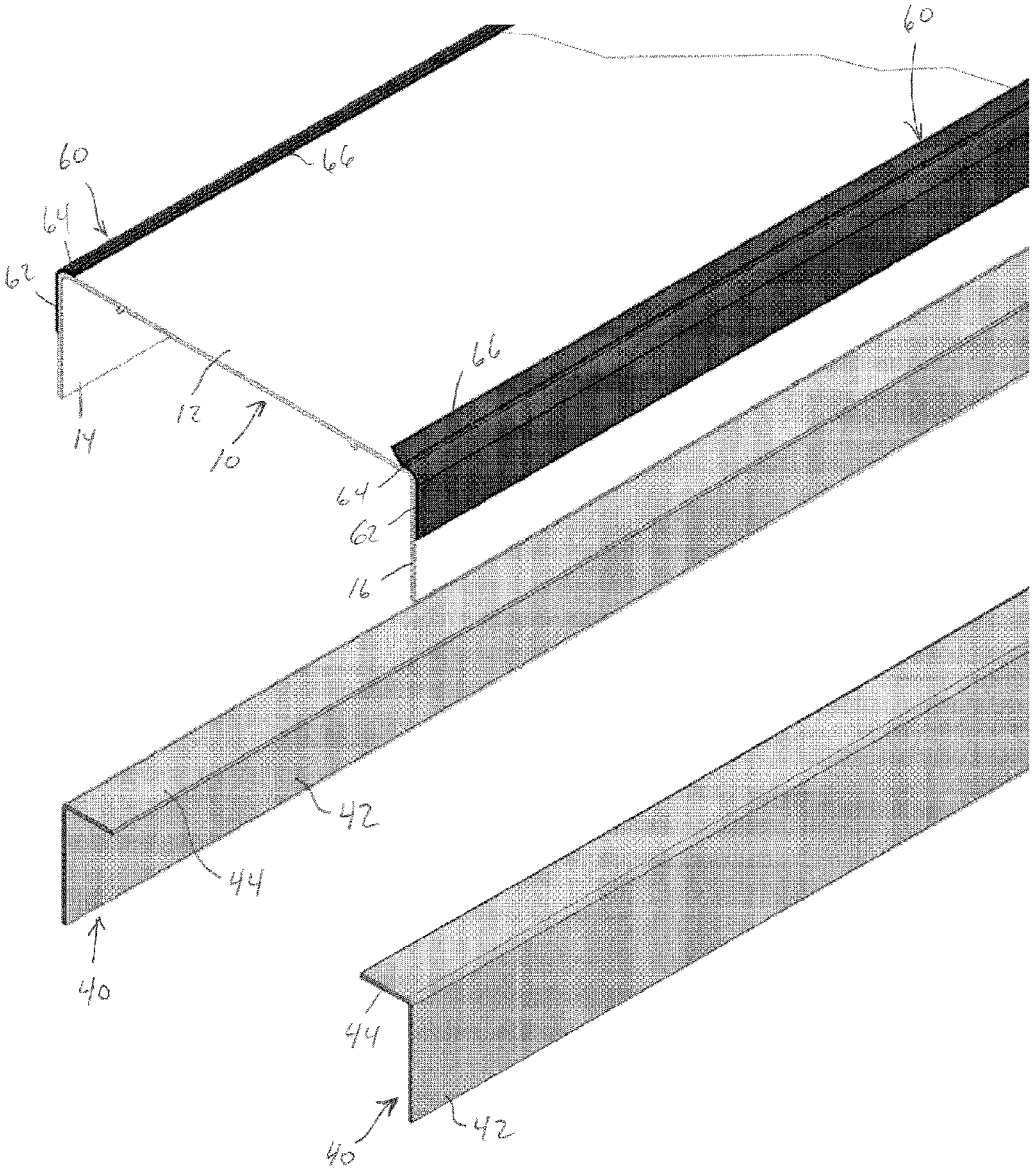
FIG. 4 is a partially exploded isometric view of an exemplary gasket assembly in accordance with an embodiment of the invention.

Referring to FIGS. 2-4, the gasket assembly 8 in accordance with an exemplary embodiment of the invention includes a member body 10. This member body 10 can preferably be of a generally rigid sound retardant material such as an extruded thermoplastic material, for example, polyvinyl chloride (PVC). The member body 10 includes a top member 12 and a first side panel 14 extending downwardly from one edge of the top member 12 and a second side panel 16 extend extending downwardly from the top member 12 at a location spatially disposed from the first side panel 14 in order to facilitate receiving in the opening 15 therebetween the track member 80 and facilitating insulating adjacent track member 80 and being positioned in surrounding engagement therewith. The top member panel 12 is configured to extend across the top track section 82 while the first side panel 14 extends along the first side track section 84 and the second side panel 16 extends along the second side track section 86.

To effectively achieve firestopping insulation, a pair of firestopping members 40 are positioned adjacent each inside corner 17 defined by the first and second side panels and the top member 12, respectively. The firestropping members 40 are preferably mirror images of each other, with each having an L-shaped configuration including a panel abutment portion 42 and a return portion 44. With such a configuration, the panel abutment portion 42 extends along the inside surface of a respective side panel 14, 16 and each return portion extends along a portion of the inside surface of the top member 12. The panel abutment portion 42 and the return portion 44 are preferably integrally formed with respect to each other, however, they may be formed separately. Additionally, while the illustrated embodiments show the two firestopping members 40 as having identical configurations, such is not required and they may be varied from one another, for example, if opposite sides of the track 80 have different configurations. Each firestopping member 40 is preferably formed as an intumescent or other similar firestopping material such as intumescent sheet material.

To facilitate retainment of the firestopping members 40 in position, it is preferable that the member body 10 define a means for facilitating positioning of firestopping members 40 adjacent to the interior surface of member body 10. For this purpose, the member body 10 may include first and second lips 18 and 20 extending inwardly and preferably obliquely inwardly from the top member 12. The lip 18 extends in a direction toward the first side panel 14 and is configured to engage a portion of the respective return portion 44 and thereby maintaining the position of the firestopping member 40 prior to assembly with a track 80. Similarly, the lip 20 extends in a direction toward the second side panel 14 and is configured to engage a portion of the respective return portion 44 and thereby maintaining the position of the firestopping member 40 prior to assembly with a track 80. If desired to further secure the firestopping members 40, the first and second side panels 14, 16 may have a lower, inwardly extending lip (not shown) defined at the respective free end of each side panel 14, 16.

To further facilitate engagement of the gasket assembly 8 with the above floor 100 or connected to structure to achieve effective acoustic and firestopping insulation, a pair of supplemental sealing members 60 are included on the outer corners 19 of the body member 10. Each supplemental sealing member 60 extends across the angled intersection between the side panels 14, 16 and the top member 12. For the purpose of reinforcement and also providing a softer basic material to more effectively seal against irregular or porous surfaces, the supplemental sealing members 60 are each preferably made from a softer material than the other portions of the gasket assembly. For example, the supplemental sealing members 60 may be manufactured from a flexible PVC material.

Each supplemental sealing member 60 has a body portion 61 configured to extend about the outside corners 19 of the member body 10, which in the illustrated embodiment is an L-shaped configuration defined by a panel abutment portion 62 and a return portion 64. With such a configuration, the panel abutment portion 62 extends along the outside surface of a respective side panel 14, 16 and each return portion extends along a portion of the outside surface of the top member 12. The supplemental sealing members 60 may be manufactured in conjunction with the member body 10, for example through co-extrusion, or they may be manufactured separately and secured thereto, for example via an adhesive or thermobonding.

Figure 5:
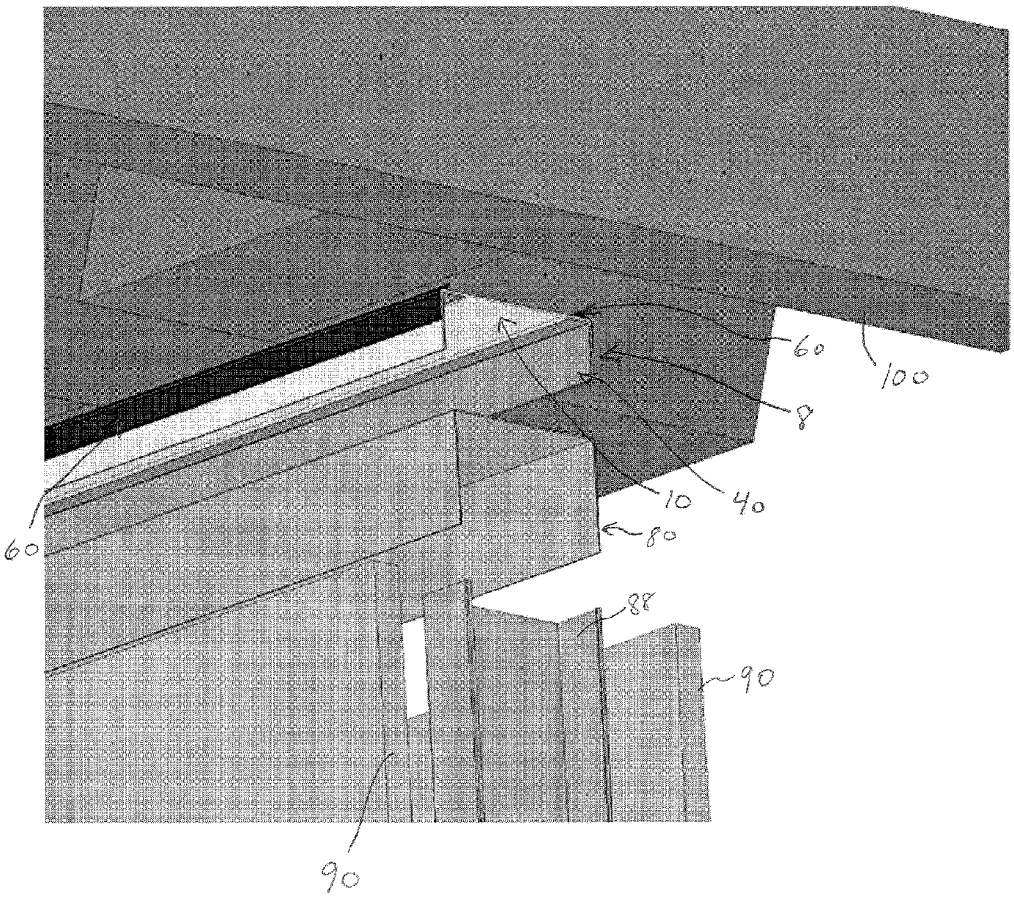
FIG. 5 is an exploded, isometric view of an exemplary head-of-wall firestopping construction in accordance with an embodiment of the present invention.
Figure 6:
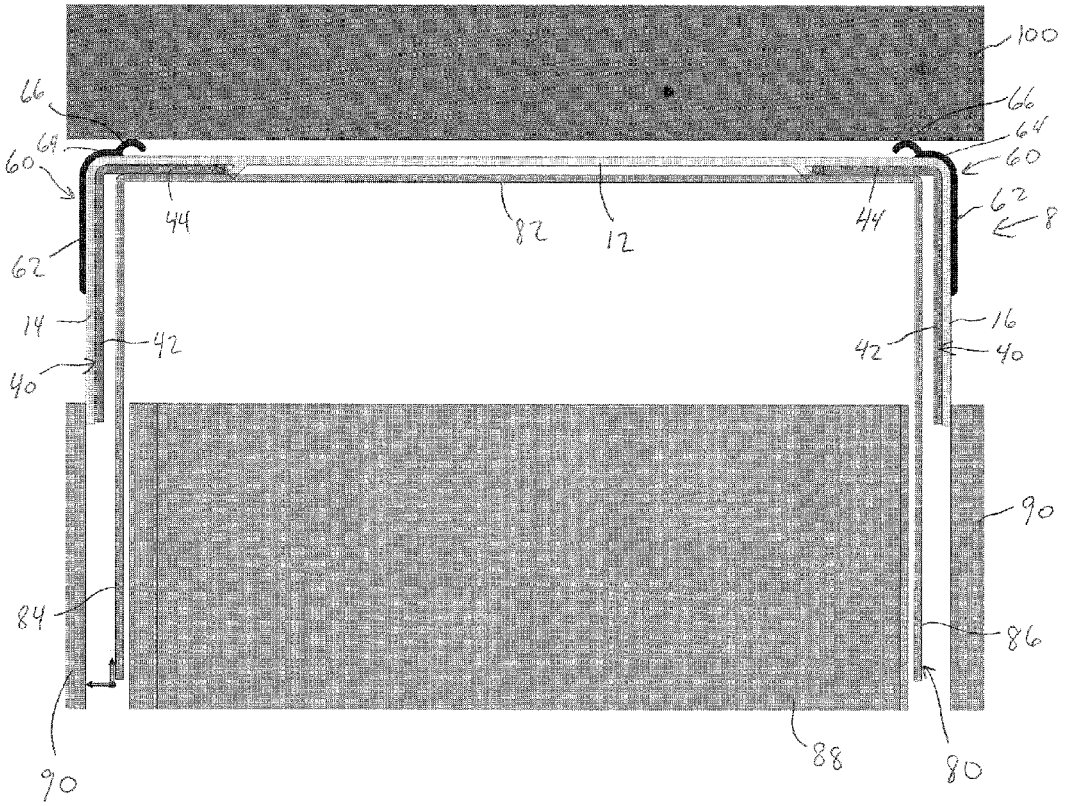
FIG. 6 is an assembled, side cross-sectional view of an exemplary head-of-wall firestopping construction in accordance with an embodiment of the present invention.

In the illustrated embodiment, an outwardly extending lip 66 extends from each return portion 64, preferably at an acute angle with respect to the top member 12. Referring to FIGS. 5 and 6, the lips 66 are configured to engage the undersurface of the floor 100 and thereby seal any gaps which may occur between the floor 100 and the member body 10. The slightly protruding return 64 and lip 66, made from a flexible material, facilitates engagement with such irregular and/or porous type surfaces for the purpose of minimizing flow therearound. While a lip 66 is illustrated, the supplemental sealing members 60 are not limited to such structure. For example, the lip may be omitted and the return portion 64 may simply lie along the top member 12. As a further exemplary embodiment, outwardly extending dimples may be provided along the outer surface of the return portion 64. Other configurations which further the sealing against the irregular floor surface may also be utilized. It is also possible to have first and second supplemental sealing members 60 are an alternate color, such as red or another contrasting color, to enhance viewing thereof from a distance for the purposes of visual inspections by inspectors or installation personnel for the purpose of assuring that the gasket member is properly installed and properly located.

The gasket assembly 8 is designed to be installed over the top of a wall construction beneath a ceiling or floor undersurface and be secured in place when the installer glues or nails the track to the floor or ceiling. Thus no additional fastening means are required for installation other than those already being utilized currently. That is, no additional fasteners are required. It should be appreciated that the materials chosen for the first and second firestopping members 38 and 44 will be preferably intumescent sheet material having a thickness of 0.04 inches.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A sealing gasket assembly for sealing a head-of-wall construction, the wall construction including a ceiling track secured relative to a floor underside and supporting a plurality of studs, the gasket assembly comprising:

a member body including a top member with first and second spaced apart side panels depending from the top member and defining an opening configured to receive the ceiling track within the member body, the intersection of the first side panel and the top member defining a first inside corner and a first outside corner and the intersection of the second side panel and the top member defining a second inside corner and a second outside corner; and a supplemental sealing member extending along each of the first and second outside corners, each supplemental sealing member manufactured from a flexible material and configured such that a panel abutment portion thereof extends along at least a portion of an outside surface of the respective side panel and a return portion extends along at least a portion of an outside surface of the top member, wherein a lip extends outwardly from each return portion at an acute angle relative to the top member.

2. The sealing gasket assembly according to claim 1 wherein the panel abutment portion, the return portion and the lip are formed integrally.

3. The sealing gasket assembly according to claim 1 wherein the member body and the supplemental sealing members are manufactured from different materials.

4. The sealing gasket assembly according to claim 3 wherein the member body is manufactured from a material having a greater rigidity than that of the supplemental sealing members.

5. The sealing assembly according to claim 3 wherein the supplemental sealing members are manufactured integrally with the member body.

6. The sealing assembly according to claim 3 wherein the supplemental sealing members are manufactured separately from the member body and secured thereto.

7. The sealing gasket assembly according to claim 1 wherein member body has an axial length and each of the supplemental sealing members extends over the axial length.

8. The sealing assembly according to claim 1 further comprising a firestopping member, manufactured from a firestopping material, positioned in each of the first and second inside corners.

9. The sealing assembly according to claim 8 wherein the firestopping material is an intumescent material.

10. The sealing assembly according to claim 8 wherein the firestopping material is an intumescent sheet material.

11. The sealing assembly according to claim 8 wherein each firestopping member is configured such that a panel abutment portion thereof extends along at least a portion of an inside surface of the respective side panel and a return portion extends along at least a portion of an inside surface of the top member.

12. The sealing assembly according to claim 11 wherein a pair of lips extend inwardly from the top member, with each lip configured to engage a respective firestopping member return portion to retain the firestopping member in position.

13. A sealing gasket assembly for sealing a head-of-wall construction, the wall construction including a ceiling track secured relative to a floor underside and supporting a plurality of studs, the gasket assembly comprising:

a member body including a top member with first and second spaced apart side panels depending from the top member and defining an opening configured to receive the ceiling track within the member body, the intersection of the first side panel and the top member defining a first inside corner and a first outside corner and the intersection of the second side panel and the top member defining a second inside corner and a second outside corner;

a supplemental sealing member extending along each of the first and second outside corners, each supplemental sealing member manufactured from a flexible material and configured such that a panel abutment portion thereof extends along at least a portion of an outside surface of the respective side panel and a return portion extends along at least a portion of an outside surface of the top member, wherein a lip extends outwardly from each supplemental sealing member return portion at an acute angle relative to the top member; and a firestopping member, manufactured from a firestopping material, positioned in each of the first and second inside corners.

14. The sealing gasket assembly according to claim 13 wherein the member body and the supplemental sealing members are manufactured from different materials.

15. The sealing gasket assembly according to claim 14 wherein the member body is manufactured from a material having a greater rigidity than that of the supplemental sealing members.

16. The sealing assembly according to claim 13 wherein the firestopping material is an intumescent material.

17. The sealing assembly according to claim 13 wherein the firestopping material is an intumescent sheet material.

18. A sealing gasket assembly for sealing a head-of-wall construction, the wall construction including a ceiling track secured relative to a floor underside and supporting a plurality of studs, the gasket assembly comprising:

a member body including a top member with first and second spaced apart side panels depending from the top member and defining an opening configured to receive the ceiling track within the member body, the intersection of the first side panel and the top member defining a first inside corner and a first outside corner and the intersection of the second side panel and the top member defining a second inside corner and a second outside corner;

a supplemental sealing member extending along each of the first and second outside corners, each supplemental sealing member manufactured from a flexible material and configured such that a panel abutment portion thereof extends along at least a portion of an outside surface of the respective side panel and a return portion extends along at least a portion of an outside surface of the top member; and a firestopping member, manufactured from a firestopping material, positioned in each of the first and second inside corners, wherein each firestopping member is configured such that a panel abutment portion thereof extends along at least a portion of an inside surface of the respective side panel and a return portion extends along at least a portion of an inside surface of the top member.

19. The sealing gasket assembly according to claim 18, wherein a lip extends outwardly from each supplemental sealing member return portion at an acute angle relative to the top member.

20. The sealing gasket assembly according to claim 19, wherein the panel abutment portion, the return portion and the lip are formed integrally.

21. The sealing gasket assembly according to claim 18, wherein the member body and the supplemental sealing members are manufactured from different materials.

22. The sealing gasket assembly according to claim 21 wherein the member body is manufactured from a material having a greater rigidity than that of the supplemental sealing members.

23. The sealing assembly according to claim 21 wherein the supplemental sealing members are manufactured integrally with the member body.

24. The sealing assembly according to claim 21 wherein the supplemental sealing members are manufactured separately from the member body and secured thereto.

25. The sealing gasket assembly according to claim 18 wherein member body has an axial length and each of the supplemental sealing members extends over the axial length.

26. The sealing assembly according to claim 18 wherein the firestopping material is an intumescent material.

27. The sealing assembly according to claim 18 wherein the firestopping material is an intumescent sheet material.

28. The sealing assembly according to claim 18 wherein a pair of lips extend inwardly from the top member, with each lip configured to engage a respective firestopping member return portion to retain the firestopping member in position.

* * * * *